US006129068A

United States Patent [19]

Wingate, Jr.

[11] Patent Number: 6,129,068

[45] Date of Patent: Oct. 10, 2000

[54] ROTARY ENGINE

[76] Inventor: John L. Wingate, Jr., 2256 Mack Rd., Douglasville, Ga. 30135

[21] Appl. No.: 09/157,296

[22] Filed: Sep. 18, 1998

[51] Int. Cl.[7] ..... F02B 53/00

[52] U.S. Cl. ..... 123/248; 418/246

[58] Field of Search ..... 123/223, 224, 123/237, 248; 418/246

[56] References Cited

U.S. PATENT DOCUMENTS

| | | | |
|---|---|---|---|
| 650,661 | 5/1900 | Stewart . | |
| 765,047 | 7/1904 | Shumway | 123/224 |
| 1,027,182 | 5/1912 | Christensen et al. | 123/224 |
| 1,107,872 | 8/1914 | Anderson | 123/224 |
| 1,147,838 | 7/1915 | Anderson et al. | 123/224 |
| 1,219,829 | 3/1917 | Marion . | |
| 1,242,693 | 10/1917 | Hibner . | |
| 1,257,156 | 2/1918 | Van Lith . | |
| 2,175,265 | 10/1939 | Johnson | 418/246 |
| 2,358,165 | 9/1944 | Ingram | 123/248 |
| 2,821,176 | 1/1958 | Koser et al. . | |
| 3,712,273 | 1/1973 | Thomas . | |
| 3,913,534 | 10/1975 | Bratten . | |
| 4,715,338 | 12/1987 | Pasquan | 123/248 |
| 5,046,465 | 9/1991 | Yi | 123/248 |

*Primary Examiner*—Michael Koczo
*Attorney, Agent, or Firm*—Kennedy, Davis & Hodge LLP

[57] ABSTRACT

A rotary engine (10) is provided having a housing (11), a rotor (34) mounted within the housing, an intake manifold 21, an exhaust manifold (33) and a reciprocating combustion containment valve (42). The rotor has a base (35) and a shoulder (36) extending from the base. A fuel injector (23), air injector (25) and spark plug (27) are all coupled to the intake manifold. The rotor is coupled to a cam (40) having a cam follower (43) thereon coupled to the combustion containment valve, whereby the movement of the combustion containment valve is synchronized with the movement of the rotor shoulder.

4 Claims, 2 Drawing Sheets

FIG. 1
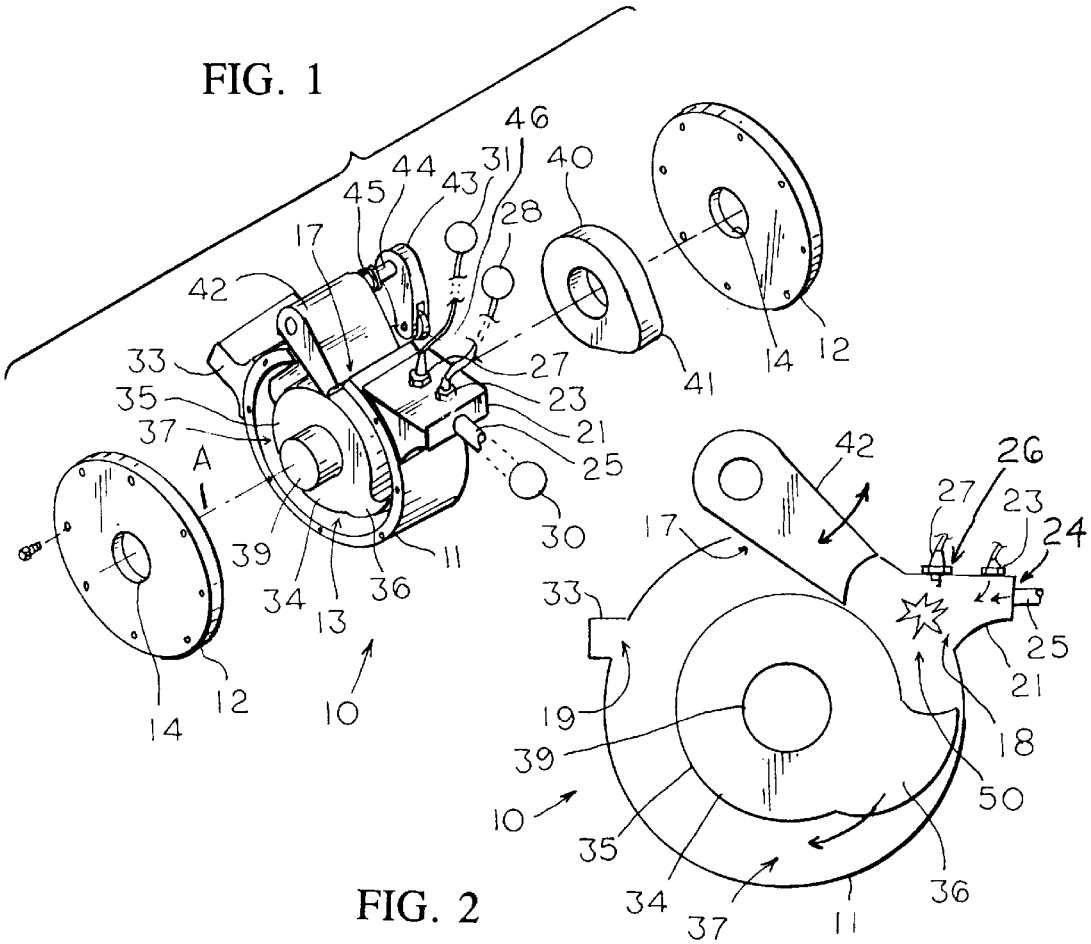
FIG. 2
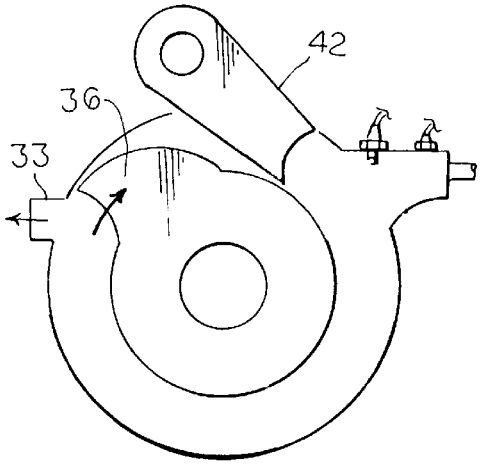
FIG. 3
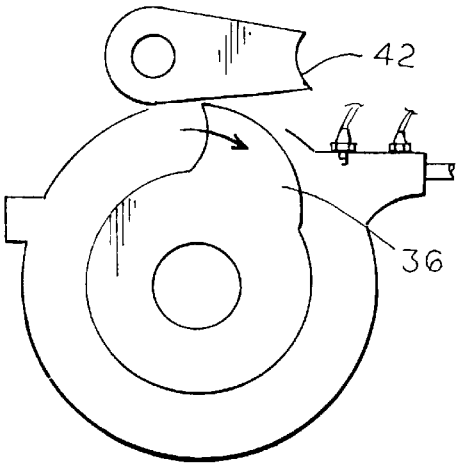
FIG. 4

ROTARY ENGINE

TECHNICAL FIELD

This invention relates to rotary internal combustion engines.

BACKGROUND OF THE INVENTION

Rotary internal combustion engines have existed for many years. As shown in U.S. Pat. No. 650,661, these engines typically include a housing cylinder having a centrally mounted rotor therein coupled to an axial shaft, a fuel intake manifold and an exhaust manifold. The rotor includes a base and a shoulder extending from the base. The combination of the rotor and housing defines an annular passage therebetween. A spring loaded door or valve cycles into the annular passage so as to close a portion of the annular channel thereby defining a combustion chamber between the valve and the rotor shoulder.

In use, the ignition of fuel within the combustion chamber forces the rotor to rotate with the shoulder moving along within the annular passage. As the shoulder passes the combustion chamber portion of the annular passage, the shoulder collides with the reciprocating valve thereby pushing the valve over the shoulder. This riding movement causes wear upon the valve and upon the rotor shoulder. This also causes wear on the rotor base as the valve drops back the rotor base with each passing of the shoulder.

It thus is seen that a need remains for a rotary engine that is less susceptible to wear. It is to the provision of such that the present invention is primarily directed.

SUMMARY OF THE INVENTION

In a preferred form of the invention, a rotary engine has a housing defining a generally cylindrical chamber having a longitudinal axis. The housing has a combustion containment valve opening, a combustion manifold opening, and an exhaust opening. The engine also has an axle aligned along the longitudinal axis, a rotor coupled to the axle positioned for rotation within the chamber about the longitudinal axis. The rotor has a base portion and a shoulder extending from the base portion. The rotor base portion and the housing define a generally annular combustion chamber therebetween. A combustion manifold is coupled to the housing which defines a subcombustion chamber in fluid communication with the combustion chamber through the housing combustion manifold opening. Fuel introduction means introduces a combustible fuel into the subcombustion chamber while air introduction means introduces air into the subcombustion chamber. Ignition means, in fluid communication with the subcombustion chamber, creates an ignition within the subcombustion chamber sufficient to ignite the combustible fuel therein. A combustion containment valve has an end portion mounted for reciprocal movement between a closed position extending into the cylindrical chamber adjacent the rotor base portion and an open position generally withdrawn from the cylindrical chamber. The end portion is configured to create a seal between the rotor and the housing with the end portion position in its closed position. A cam coupled to the rotor for rotation about the axis. A cam follower is coupled to the combustion containment valve which is configured to ride upon the cam and actuate the movement of the combustion containment valve between its open position and its closed position. With this construction and with the combustion containment valve positioned at its closed position, the ignition of fuel causes a force within the combustion manifold which causes the rotor to rotate within the housing about the axis thereby driving the axle, and whereby the rotation of the rotor causes the rotation of the cam which in turn moves the cam follower thereon thereby moving the coupled combustion containment valve coupled thereto to move to its open position.

BRIEF DESCRIPTION OF THE DRAWINGS

FIG. 1 is an exploded view, in perspective, of a rotary engine embodying principles of the invention in a preferred form.

FIGS. 2–4 are a sequence of side views of the rotary engine of FIG. 1 which show, in sequence, the operation of the engine.

DETAILED DESCRIPTION

Figure 5:
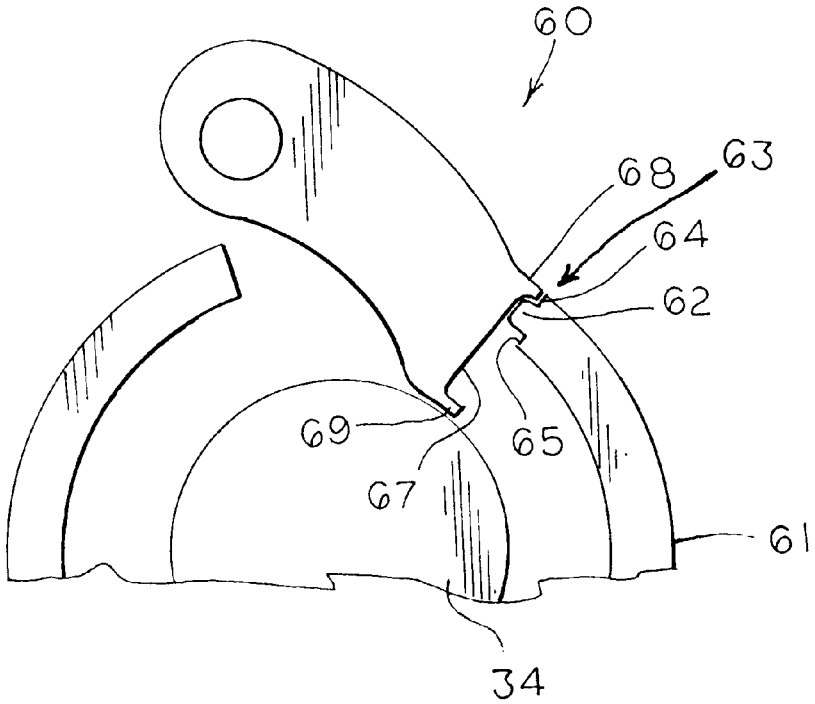
FIG. 5 is a side view of a portion of a rotary engine incorporating a combustion containment valve and a cylindrical housing in alternative preferred forms.

With reference next to the drawings, there is shown a rotary engine 10 having a generally cylindrical housing 11 and two oppositely disposed cylinder end plates 12, the combination of which defines an internal chamber 13. Each end plate 12 has a shaft opening 14 therethrough and an unshown bearing coupled thereto. The housing 11 has a combustion containment valve opening 17, a combustion manifold opening 18, and an exhaust opening 19.

A sub-combustion intake manifold 21 is coupled to the housing 11 in fluid communication with the internal chamber 13 through the housing combustion manifold opening 18. The intake manifold 21 has a fuel intake port in which a fuel injector 23 is mounted, an air intake port 24 in which an air injector 25 is mounted, and an ignition port 26 in which a spark plug 27 is mounted. The fuel injector 23 is coupled to a conventional fuel injection system 28. The air injector 25 is coupled to a pressurized air supply 30, such as a turbocharger. The spark plug 27 is coupled to a conventional ignition system 31 including a timing mechanism and an electric current generating system. An exhaust manifold 33 is coupled to the housing in fluid communication with the internal chamber 13 through the housing exhaust opening 19.

A rotor 34 is mounted within the housing internal chamber 13 for axial rotation therein. The rotor 34 has a generally circular base 35 and a shoulder 36 extending from the base 35. The rotor 34 and housing 11 define a generally annular passage 37 therebetween. The rotor 34 is coupled to a drive shaft 39 which is journaled through the end plate shaft openings 14 and adjacent unshown bearings so as to extend along an axis A through the center of the housing internal chamber 13 and rotor. A cam 40 is coupled to the drive shaft 39. The cam 40 has a rising node 41 aligned with rotor shoulder 36.

The rotary engine 10 also has a combustion containment valve 42 coupled to a cam follower 43 by a shaft 44. The cam follower 43 has a roller 46 positioned to ride upon the cam 40. The cam follower 43 is biased against the cam 40 by a spring 45. The combustion containment valve 42 is moveable between an engaged or closed position extending through the housing combustion containment valve opening 17 and a withdrawn or open position removed from the housing internal chamber 13 to allow the passing of the rotor shoulder 36. In the closed position the valve 42 is in sealing engagement against the rotor 34, as shown in FIGS. 1–3.

With the combustion containment valve 42 in its engaged position a combustion chamber 50 is formed within the annular passage 37 between the combustion containment valve and the rotor shoulder 36.

In use, as the rotor 34 rotates past the combustion containment valve 42, initially by actuation of a conventional, unshown starter motor, a vacuum is created within the sub-combustion intake manifold 21 and the combustion chamber 50. As this occurs, the fuel injector 23 injects fuel into the intake manifold 21 in the path of pressurized air expelled from the air injector 25 thereby creating an air/fuel mixture. As the rotor shoulder 36 passes the end of the combustion manifold opening 18 an electric current is passed to the spark plug 27 so as to ignite the air/fuel mixture and thereby cause combustion of the air/fuel mixture within the combustion chamber 50. The combustion force upon the rotor shoulder 36 forces the rotor 34 to rotate about axis A, thereby rotating the drive shaft 39.

As the rotor shoulder 36 passes the housing exhaust opening 19 the combustion gases pass through the housing exhaust opening 19 and exits the exhaust manifold 33. As the rotor 34 reaches this position, shown in FIGS. 2 and 3, the cam follower 43 commences to ride upon the cam rising node 41, thereby causing the combustion containment valve 42 to move towards its withdrawn position allowing the unencumbered passage of the rotor shoulder 36 beneath the containment valve. The momentum of the rotor 34 causes the shoulder 36 to continue past the containment valve 42, also causing the roller 46 of the cam follower 43 to ride down the cam 40 thereby forcing the combustion containment valve back down against the rotor. In this manner, the rotor 34 completes an entire cycle as it returns to its initial position.

It should be understood that some conventional elements of a typical engine, such as starters, cooling systems, generators and lubrication systems, as well as other details necessary to the conventional operation of an engine, have not been described herein for clarity of explanation. These conventional systems of course are readily adaptable to the just described embodiment by one skilled in the art. It should also be understood that as an alternative to the combination of a fuel injection system with pressurized air injection other types of fuel mixing devices may be used such as carburetors and unpressurized fuel injection systems. However, the pressurized air system is preferred in that it is believed that rotary engines encounter difficulty intaking large volumes of air and the introduction of pressurized air into the engine helps alleviate this difficulty.

Referring next to FIG. 5, there is shown a combustion containment valve 60 and a cylindrical housing 61 in alternative embodiments to those previously described. Here, the housing 61 has an elongated sealing flange or step 62 extending from an edge 63 of the housing facing the combustion containment valve 60. The sealing step 62 partially defines an upper recess 64 and a lower recess 65. The combustion containment valve 60 has an elongated recess 67 extending between an upper sealing flange 68 and a lower sealing flange 69.

In use, with the combustion containment valve 60 in its engaged position, as shown in FIG. 5, the upper sealing flange 68 mates against the housing sealing step 62 and within the housing upper recess 64. This mating of the containment valve 60 and the housing 61 aids in providing a proper seal through combustion. The mating of the valve upper sealing flange 68 against the housing sealing step 62 also prevents the valve 60 from being forced against the rotor 34 during combustion.

After combustion, the interaction of the valve lower sealing flange 69 against the housing sealing step 62 limits the upper movement of the valve as it is moved to its withdrawn position.

Figure 6:
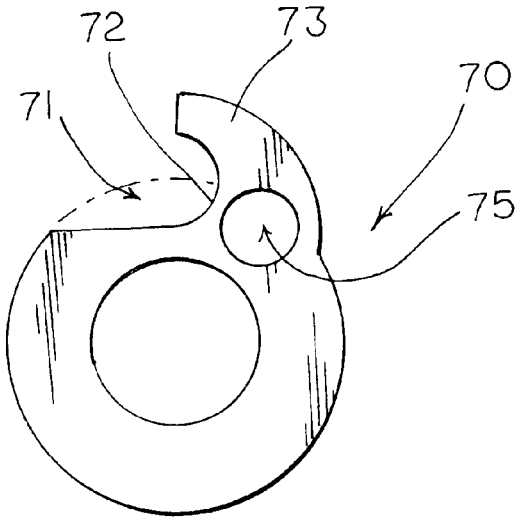
FIG. 6 is a side view of a rotor in another preferred form.

Referring next to FIG. 6, there is shown a rotor 70 in an alternative embodiment. Here, the rotor 70 has an elongated recess or cavity 71 partially defined by a recess wall 72 extending to a rotor shoulder 73. The recess wall 72 essentially provides an increased surface area of the rotor shoulder 73 to receive the combustion force of the ignited fuel. The increased surface area of the shoulder 73 is believed to increase the power of the engine. The rotor is also provided with a void 75 to offset the weight of the rotor shoulder, i.e. to balance the entire rotor. The combination of the decreased mass of the rotor 34 due to the void 75 and the decreased radius about which the combustion force is directed due to the recess 71 reduces the moment of inertia of the rotor 34 and more efficiently utilizes the combustion force to drive the engine.

It should be understood that as an alternative the configuration of the elongated flange 62 and the recess 67 may be reversed, i.e. the housing may have a recess within which the flange of the containment valve may move. It should also be understood that the engine may include a cam and cam follower on each side of the housing for stability.

It thus is seen that a rotary engine is now provided which reduces wear upon the rotor. It should of course be understood that many modifications may be made to the specific preferred embodiment described herein without departure from the spirit and scope of the invention as set forth in the following claims.

What is claimed is:

1. A rotary engine comprising:

a housing defining a generally cylindrical chamber having a longitudinal axis, said housing having a combustion containment valve opening, a combustion manifold opening, and an exhaust opening;

an axle aligned along said longitudinal axis;

a rotor coupled to said axle and positioned for rotation within said chamber about said longitudinal axis, said rotor including a base portion having a generally uniform circumference about said axis and a shoulder extending from said base portion to a radially outermost point, said rotor base portion and said shoulder defining a recess extending radially inward from said circumference of said base portion and between said radially outermost point of said shoulder and said axle, said rotor base portion and said housing defining a generally annular combustion chamber therebetween;

a combustion manifold coupled to said housing defining a subcombustion chamber in fluid communication with said combustion chamber through said housing combustion manifold opening;

fuel introduction means for introducing a combustible fuel into said subcombustion chamber;

air introduction means for introducing air into said subcombustion chamber;

ignition means in fluid communication with said subcombustion chamber for creating an ignition within said subcombustion chamber sufficient to ignite a combustible fuel therein;

a combustion containment valve having an end portion mounted for reciprocal movement between a closed position extending into said cylindrical chamber adjacent said rotor base portion and an open position generally withdrawn from said cylindrical chamber, said end portion being configured to create a seal between said rotor and said housing with said end portion positioned in said closed position;

a cam coupled to said rotor for rotation about said axis;

a cam follower coupled to said combustion containment valve configured to ride upon said cam and actuate the movement of said combustion containment valve between said open position and said closed position;

whereby with the combustion containment valve positioned at its closed position, the ignition of fuel causes a force within the combustion manifold which causes the rotor to rotate within the housing about the axis thereby driving the axle, and whereby the rotation of the rotor causes the rotation of the cam which in turn moves the cam follower thereon thereby moving the coupled combustion containment valve coupled thereto to move to its open position.

2. A rotary engine comprising:

a housing defining a generally cylindrical chamber having a longitudinal axis, said housing having a combustion containment valve opening, a combustion manifold opening, and an exhaust opening;

an axle aligned along said longitudinal axis;

a rotor coupled to said axle and positioned for rotation within said chamber about said longitudinal axis, said rotor having a base portion and a shoulder extending from said base portion, said rotor base portion and said housing defining a generally annular combustion chamber therebetween;

a combustion manifold coupled to said housing defining a subcombustion chamber in fluid communication with said combustion chamber through said housing combustion manifold opening;

fuel introduction means for introducing a combustible fuel into said subcombustion chamber;

air introduction means for introducing air into said subcombustion chamber;

ignition means in fluid communication with said subcombustion chamber for creating an ignition within said subcombustion chamber sufficient to ignite a combustible fuel therein;

a combustion containment valve having an end portion including a radially outer flange and a radially inner flange, said end portion mounted for reciprocal movement between a closed position extending into said cylindrical chamber adjacent said rotor base portion and an open position generally withdrawn from said cylindrical chamber and said end portion being configured to create a seal between said rotor and said housing with said end portion positions in said closed position, and said housing having a step sized and shaped to engage said radially outer flange and said radially inner flange to limit movement of said valve;

a cam coupled to said rotor for rotation about said axis;

a cam follower coupled to said combustion containment valve configured to ride upon said cam and actuate the movement of said combustion containment valve between said open position and said closed position;

whereby with the combustion containment valve positioned at its closed position, the ignition of fuel causes a force within the combustion manifold which causes the rotor to rotate within the housing about the axis thereby driving the axle, and whereby the rotation of the rotor causes the rotation of the cam which in turn moves the cam follower thereon thereby moving the coupled combustion containment valve coupled thereto to move to its open position.

3. A rotary engine comprising:

a housing defining a generally cylindrical chamber having a longitudinal axis, said housing having a combustion containment valve opening, a combustion manifold opening, and an exhaust opening;

an axle aligned along said longitudinal axis;

a rotor coupled to said axle and positioned for rotation within said chamber about said longitudinal axis, said rotor having a base portion and a shoulder extending from said base portion having a forward facing wall and a rearward facing wall, said base portion having a recess adjacent said shoulder defined by a recess wall, said recess wall extending to said rearward facing wall, said rotor base portion and said housing defining a generally annular combustion chamber therebetween;

a combustion manifold defining a subcombustion chamber in fluid communication with said combustion chamber through said housing combustion manifold opening;

fuel introduction means for introducing a combustible fuel into said subcombustion chamber;

pressurized air introduction means for introducing pressurized air into said subcombustion chamber;

ignition means in fluid communication with said subcombustion chamber for creating an ignition within said subcombustion chamber sufficient to ignite a combustible fuel therein;

a combustion containment valve having an end portion mounted for reciprocal movement between a closed position extending into said cylindrical chamber closely adjacent said rotor base portion and an open position generally withdrawn from said cylindrical chamber, and said end portion being configured to create a seal between said rotor and said housing with said end portion positioned in said closed position, and said combustion containment valve end portion having a radially outer flange and a radially inner flange and said housing having a step sized and shaped to engage said radially outer flange to create a seal and to engage said radially inner flange to limit the movement of said containment valve towards its open position, whereby with the combustion containment valve positioned at its closed position, the ignition of fuel causes a force within the combustion manifold which causes the rotor to rotate within the housing about the axis thereby driving the axle.

4. The rotary engine of claim 3 wherein said base portion has a generally uniform circumference, said shoulder has a radially outermost point, and said base portion and said shoulder define said recess wall extending from said base portion circumference radially inward and between said outermost point and said axle.

* * * * *